US006424366B1

(12) United States Patent
Probian et al.

(10) Patent No.: US 6,424,366 B1
(45) Date of Patent: Jul. 23, 2002

(54) METHOD AND DEVICE FOR REVERSIBLE IMAGING OF A PRINTING FORM

(75) Inventors: Dirk Probian, Gablingen; Josef Schneider, Diedorf, both of (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/641,457

(22) Filed: Aug. 18, 2000

(30) Foreign Application Priority Data

Aug. 18, 1999 (DE) ..... 199 39 240

(51) Int. Cl.[7] ..... B41J 2/385; B41J 2/325
(52) U.S. Cl. ..... 347/156; 347/176
(58) Field of Search ..... 347/213, 228, 347/264, 179, 187, 176, 156; 101/46, 471; 430/19, 63; 399/67, 68, 71

(56) References Cited

U.S. PATENT DOCUMENTS

| | | | | |
|---|---|---|---|---|
| 3,964,389 A | | 6/1976 | Peterson | 430/302 |
| 5,129,321 A | * | 7/1992 | Fadner | 101/467 |
| 5,395,729 A | | 3/1995 | Reardon et al. | 430/200 |
| 5,402,220 A | * | 3/1995 | Tanaka et al. | 399/68 |
| 5,932,385 A | * | 8/1999 | Takamura et al. | 430/63 |

FOREIGN PATENT DOCUMENTS

| | | | | |
|---|---|---|---|---|
| DE | 3809915 A1 | | 10/1989 | B41M/1/08 |
| DE | 19624441 C1 | | 12/1997 | B41C/1/05 |
| EP | 0698488 B1 | | 2/1996 | B41C/1/10 |
| JP | 59-201037 | * | 11/1984 | G03B/27/34 |
| JP | 6-71936 | * | 3/1994 | B41J/2/44 |
| WO | WO 98/08142 | | 2/1998 | |

* cited by examiner

*Primary Examiner*—Hai Pham
(74) *Attorney, Agent, or Firm*—Cohen, Pontani, Lieberman & Pavane

(57) ABSTRACT

A method for reversible imaging of a printing form is provided included feeding a coated transfer film between a printing form and an image information transfer unit having a transfer head. A surface of the printing form is then imaged using image data oriented activation to transfer the transfer film coating in the form of image spots to the printing form. The transfer film is removed from between the printing form and the image information transfer unit. The transferred image spots are fixed on the printing form by re-imaging or fixing the image spots using image data oriented activation. Remaining image information from the printing form is removed or erased once the printing operation is complete so that the printing form is capable of being used in a subsequent printing operation. A device for performing the method is also provided. Optionally, a single laser beam or a plurality of laser beams may be used in the device.

10 Claims, 2 Drawing Sheets

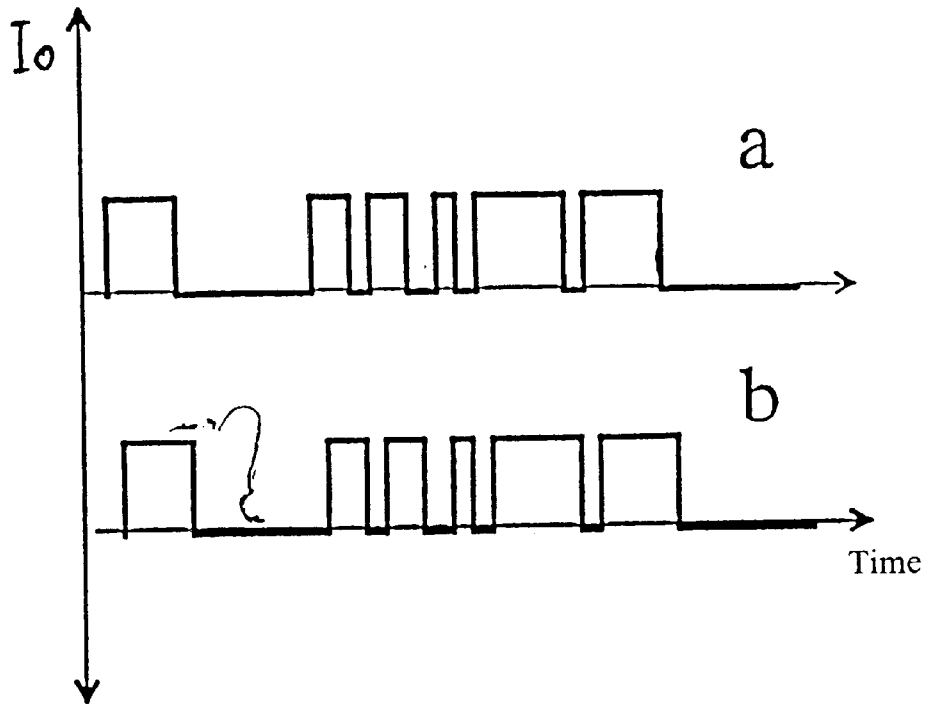
Fig. 2 : a) Image data flow b) Activation of the IR laser for fixing

METHOD AND DEVICE FOR REVERSIBLE IMAGING OF A PRINTING FORM

BACKGROUND OF THE INVENTION

1. Field of the Invention

The present invention relates to a method for reversible imaging of a printing form by image controlled heating of a surface by means of thermal transfer. More particularly, the present invention provides a method for reversibly imaging a printing form by means of heat treating a thermal transfer material to ensure uniform printing quality without having to adapt the thickness of the layer of the thermal transfer material according to the desired impression and to simplify erasure of the image from the printing form.

2. Description of the Related Art

There are known printing methods in which a printing form is provided with thermal transfer material according to an image by a thermal transfer film. The printing form is preferably on a printing form cylinder. Transfer of the transfer material is preferably laser induced. Other energy sources, such as heating elements, heating lines, heating matrices or the like may also be used. The printing form is then inked with printing inks, in particular for an offset method. The printing ink of the ink-carrying regions is transferred, if appropriate, via a rubber roller onto the substrate to be printed.

In order to change the printing subjects quickly it is desirable to perform the operation within the printing machine by computer control without moveable parts being changed. This is particularly true for small impressions.

German reference DE 38 09 915 A1 discloses a printing method where image information in the form of ink-absorbing surface elements transfers image information onto the lipophobic surface of the printing form or the printing form cylinder via an image information transfer unit within the printing machine. A thermal transfer film is provided with a thermosensitive or electrothermosensitive coating which has oleophilic or ink-absorbing properties. The image information transfer unit includes a printing head such as a line of heating elements, an electrode, an energy beam or any other heat-generating unit, in particular a laser printing head. In order to transfer an image information item, the printing head is controlled via corresponding image signals, in such a way that, for each image dot, it introduces heat and pressure to the thermal transfer film and consequently causes a punctiform transfer of the coating of the film onto the surface of the printing form cylinder. At the same time the printing form cylinder rotates, and the printing head is correspondingly traversed, so that the printing form can be imaged, for example spirally, on the printing form cylinder by the thermal transfer film.

For a repeated image-conforming coating of a printing form of this type, subassemblies are arranged within the printing machine. The subassemblies consist of a means for supplying a thermal transfer film to the printing form cylinder, a laser printing head capable of being coordinated with the rotational movement of the printing form cylinder, an electronically controlled image-spot transfer unit for activating the laser printing head and an element which removes the image-conforming coating from the printing form again. The subject presented in European reference EP 0 698 488 B1 fulfills this requirement. As shown in German reference 196 24 441 C1, the element for removing the image-conforming coating or the thermal transfer material from the surface of the printing form may be a high-pressure cleaner.

The strip-like thermal transfer film disclosed in European reference EP 0 698 488 B1 is distinguished by a comparatively thin coating of thermal transfer material. The imaging layer on the printing form cylinder is therefore thin, so that the image-conforming coating can also be readily removed, i.e. the printing form cylinder can be erased again more easily or more quickly due to the reduction in thickness of thermal transfer material.

However, it is also known that the impression constancy of a printing form imaged by thermal transfer, or the uniform printing quality over the entire number of copies of a specific printing product to be printed, depends directly on the layer thickness of the thermal transfer material. When the thickness of the thermal transfer layer is increased to improve impression constancy, then removal of the image-conforming coating from the printing form during erasure becomes difficult, resulting in ink streaks or ghost images, i.e. "scumming" occurs on the printing form or in the printing image.

The goal is to ensure that the printing form coated in conformity to the image affords an adequate service life for as large an impression as possible and to obtain uniform printing quality. In addition, it is important to assure that the thermal transfer material can be removed from the printing form after the printing operation, in a simple environmentally friendly manner, so that a new imaging and printing operation can commence immediately.

For this reason, attempts have already been made to use a thin-layer thermal transfer film in the printing method described above but then to perform infrared curing of the image-conforming coating on the printing form to achieve additional curing of this imaging layer and to increase impression constancy. During this thermal after treatment (fixing), the polymer of the imaging layer is heated above the glass temperature by the introduction of heat.

For this purpose, infrared irradiation of the layer produced on the printing form by the punctiform transferred thermal transfer material is performed, increasing adhesion to the surface of the printing form, as compared with non-irradiated regions on the printing form. Infrared irradiation of this type also introduces laser-induced heat. However, this infrared curing (since it is carried out over a large area) leads to uneven treating and pronounced heating of individual regions of the printing form. In particular, subject-dependent non-uniform heating of the imaging layer on the printing form occurs, i.e. the full-tone image regions heat up to a greater extent than graduated half-tone image regions. In an extreme case, this means that the property of improved impression constancy is distributed non-uniformly on the printing form. As a result, a loss of registry can occurs due to subject-dependent thermal expansion, or impression constancy cannot been achieved for the printing form.

SUMMARY OF THE INVENTION

The object of the present invention is to reversibly image a printing form by means of a thermal transfer material, to ensure a large impression having a uniform printing quality, without having to adapt the thickness of the layer of the thermal transfer material according to the desired impression. A further object of the present invention is to simplify the erasure of the image from the printing form.

Briefly stated, the present invention is a method for reversible imaging of a thermal transfer. First, imaging of the printing form is performed by punctiform activation. This involves image-controlled heating of the thermal transfer material on the transfer film, transfer of the image dots onto the surface of the printing form, followed by removal of the transfer film between the printing form and the image information transfer unit. In a further step, image-data-oriented activation is performed, (i.e. image-controlled heating of the surface of the printing form) so that the image information transferred in a pixel-like manner in the first step is heated, pixel by pixel, for a second time on the printing form. After the printing operation with the image information fixed in this way, the polymer parts can be removed from the printing form again.

Since the already transferred image information is activated a second time, preferably by a laser printing head without the transfer film being interposed, the imaging energy is increased and the image dots are cured more effectively, so that the impression constancy of the layer of thermal transfer material is clearly improved, without having to increase the thickness of the layer.

Preferably, a strip-like thermal transfer film consisting of a substrate layer, i.e. a carrier film or carrier strip, a substantially transparent heat-resistant plastic and a donor layer (i.e. the thermosensitive transferable layer) that is applied to the substrate layer are used as is known. The action of an energy source, preferably a laser beam from the rear side of the thermal transfer strip (i.e. from the uncoated side), induces heat in the donor layer and leads to softening and ultimately detachment of the thermal transfer material. Once transferred onto the printing form, the thermal transfer material immediately cools and adheres to the printing form due to the high heat capacity of the printing form material, for example metal. In this case, the thermal transfer film, in particular the layer of thermal transfer material, is preferably about 0.5 to 3 $\mu$m thick.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The present invention is described in further detail below, with reference to the accompanying drawings, in schematic form, as follows:

FIG. 2*a* shows diagrammatically a graph of the image-data-oriented activation of the laser source during the imaging step.

FIG. 2*b* shows diagrammatically a graph of the image-data-oriented activation of the laser source during the fixing step.

DETAILED DESCRIPTION OF THE PRESENTLY PREFERRED EMBODIMENTS

Figure 1A:
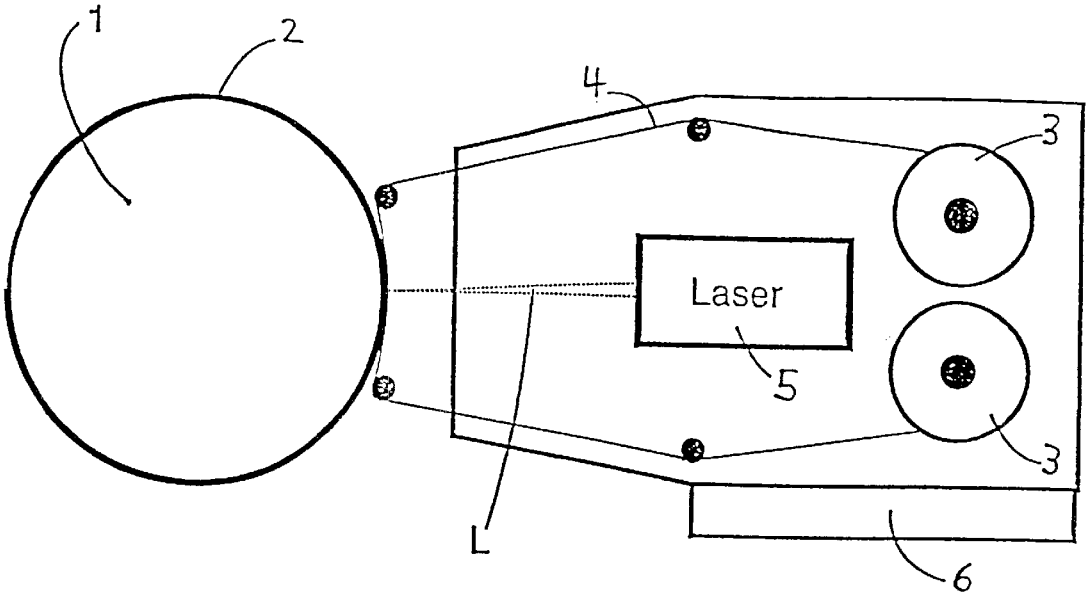
FIG. 1*a* is a side view of a known device for imaging a printing form.
Figure 1B:
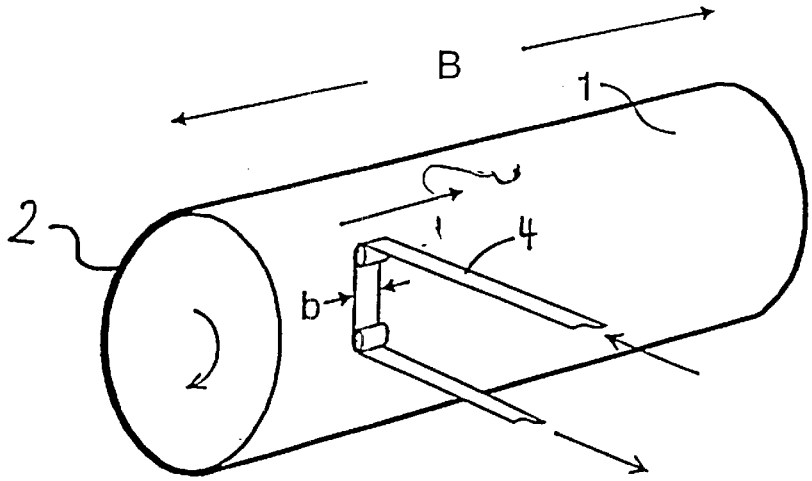
FIG. 1*b* is a perspective illustration of the device of FIG. 1*a*.

Referring now to FIG. 1, a known device for imaging a printing form by thermal transfer is shown (FIG. 1*a*: side view, FIG. 1*b*: a perspective illustration). A printing form 2 is attached as a printing plate or as a sleeve-shape printing form on a printing form cylinder 1 (it is also possible to image the surface of the cylinder itself). A strip transport mechanism 3 leads a strip-like thermal transfer film 4 of width b past, near to or in contact with the surface of the printing form 2. An image information transfer unit (not shown) comprises a printing head 5 containing at least one laser source which focuses one or more beams onto the transfer strip 4. The laser source 5, preferably an IR laser, and the strip transport mechanism 3 are preferably jointly arranged on a traversing unit 6, by means of which they can be moved over the width B of the printing form which rotates together with the cylinder 1 when activated. The duration of laser imaging of a printing form is typically 1 to 2 minutes.

According to the present invention, a further step, i.e. a second imaging step is performed in that step 1 is repeated except without the transfer film being interposed. The duration is the same as in the first step, so that the imaging time is virtually doubled.

There are two possible procedures in this case. The image-data-oriented activation of the surface of the printing form (second step) may be carried out identically to the image-controlled heating of the transfer film in the first step. FIG. 2 shows diagrammatically a graph of the image-data-oriented activation of the laser source, a) showing the image data flow during imaging (first step) and b) showing the image-data-oriented activation on the surface of the printing form (fixing step). Alternatively, the image-data-oriented activation of the surface of the printing form (fixing step) may be carried out in reverse order to the image-controlled heating of the transfer film in the first step. For example, during the imaging of the printing form 2, the printing head 5 (FIG. 1) traverses along the width B of the printing form once from left to right. After removal of the transfer film 4, the printing head 5 travels back into the initial position once from right to left and at the same time, on the return path, activates the surface of the printing form with image-data-orientation in reverse order to the outward path. Path optimization is thereby achieved, since "idling" of the printing head 5 into the initial position and therefore a path distance B are avoided.

Preferably, the same laser source is used for both the first and the second step. However, the preferred combined formation of the laser source as an imaging unit and as a fixing device does not rule out the use of different laser sources.

The polymer layer applied to the printing form is heated briefly above the Tg temperature (glass temperature) of the polymer by means of the laser source 5. Heating is carried out locally and within a narrow time limit. Damage to the "image-free" space can consequently be virtually ruled out. In contrast to this, in the case of heating/irradiation over a large area, as has previously been done, a disturbance in the ink/water equilibrium can occur. Spatial limitation may be achieved by a controlled variation in the intensity distribution. Diffractive hybrid elements are the most suitable for this purpose.

It may be advantageous, however, to perform the second image-controlled heating on the printing form, only in the case of a specific impression size. In a preferred embodiment for an impression size of up to about 5000, the printing form is made to be reversibly imaged in the conventional way solely according to the imaging step of the method according to the invention. The re-imaging step of the method according to the present invention is performed only in the case of larger impression sizes (typically, from about 5,000 to about 50,000).

In another preferred embodiment, the erasing step following the finished printing steps for removing the image information from the surface of the printing form, may be performed by a laser source and with image-data orientation. Specifically, an adjustment of the power of the laser beam is made so that the image information can simply be burned away, pixel by pixel, from the surface of the printing form.

German reference DE 195 03 951 C2 discloses a laser source which can be switched to a plurality of intensity steps. In other words, an appropriate power adjustment i.e. beam strength per unit area, hence the beam density, can be set.

Consequently, it is possible, for the structural unit of the printing head with a single laser source for imaging and fixing, to also perform the erasing operation. Thus, a laser source in the printing head can be used first for imaging, then for fixing the image elements on the printing form and finally for erasing the image information.

However, the device for thermal transfer may, of course, also be designed so that the printing head 5 comprises, as a structural unit, a first laser source for imaging the printing form, a second laser source with specially adapted intensity distribution for the image-data-oriented heating of the surface of the printing form 2 and a further laser source with a correspondingly adapted beam density for removing the image information from the surface of the printing form.

Although the method according to the present invention may be performed in a printing machine, the invention is nevertheless in no way restricted to the image-conforming coating of a printing form within a printing machine, but, in principle, is also suitable for producing a printing form outside a printing machine. In this case, the printing-image carrier, i.e. the printing form, may be a seamless printing form cylinder, a cylinder sleeve or else a conventional uncoated printing plate which is tension-mounted onto an impression cylinder.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A method for reversible imaging of a printing form, comprising the steps of:

feeding a transfer film comprising a coating between a printing form and an image information transfer unit comprising a printing head;

imaging a surface of the printing form using image data oriented activation to transfer the transfer film coating in the form of image spots to the printing form;

removing the transfer film from between the printing form and the image information transfer unit;

fixing the transferred image spots on the printing form by re-imaging the image spots using image data oriented activation; and erasing a remaining image from the printing form once a printing operation is complete so that the printing form is capable of being used in a subsequent printing operation.

2. The method according to claim 1, wherein the image data oriented activation of the imaging step and the image data oriented activation of the fixing step are performed with the fixing step being carried out with a delay behind the imaging step.

3. The method according to claim 1, wherein the image data oriented activation of the imaging step is performed in a first order and the image data oriented activation of the fixing step is performed in a second order that is reverse to the first order.

4. The method according to claim 1, wherein the imaging step and the fixing step are of equal duration.

5. The method according to claim 1, wherein the printing head comprises a laser source and the imaging step and the fixing step both include using the laser source.

6. The method according to claim 1, wherein the fixing step includes selectively fixing the transfer image only when an impression size is at least about 5,000.

7. The method according to claim 1, wherein the erasing step includes burning an image from a surface of the printing form with a power adjustable laser source.

8. The method according to claim 1, including performing the imaging step and the fixing step using a common laser source.

9. The method according to claim 8, including performing the erasing step using the common laser source.

10. A device for use in reversible imaging of a printing form having a surface, comprising:

means for supplying a transfer film to the printing form; and a subassembly comprising a printing head comprising at least one laser source capable of imaging the printing form, fixing a surface of the printing form by image data oriented heating of the surface and erasing the image from the surface of the printing form.

* * * * *